US008230939B1

(12) United States Patent
Reynolds

(10) Patent No.: US 8,230,939 B1
(45) Date of Patent: Jul. 31, 2012

(54) COOKSTOVE FIRE EXTINGUISHING SYSTEM

(75) Inventor: Joe Dale Reynolds, Katy, TX (US)

(73) Assignee: Brian Scott Reynolds, Houston, TX (US), part interest ( * ) Notice: Subject to any disclaimer, the term of this patent is extended or adjusted under 35 U.S.C. 154(b) by 0 days.

(21) Appl. No.: 11/647,055

(22) Filed: Dec. 27, 2006

(51) Int. Cl.
*A62C 3/00* (2006.01)

(52) U.S. Cl. ..... 169/65; 169/16; 169/19; 169/56; 169/21; 169/22; 169/61; 340/577

(58) Field of Classification Search ..... 169/26, 169/28, 29, 42, 46, 47, 51, 56, 57, 59, 60, 169/65, 70, 88, DIG. 3; 340/577
See application file for complete search history.

(56) References Cited

U.S. PATENT DOCUMENTS 2,856,010 A * 10/1958 Brill et al. ..... 169/9
3,209,837 A * 10/1965 Freedman ..... 169/42
3,412,356 A * 11/1968 Van Horssen ..... 337/150
3,463,233 A * 8/1969 Haessler ..... 169/47
3,653,443 A * 4/1972 Dockery ..... 169/61
3,772,499 A 11/1973 Fritzsche
3,773,111 A * 11/1973 Dunn ..... 169/26
3,824,374 A * 7/1974 Mayher ..... 219/510
3,865,192 A * 2/1975 Dunphy ..... 169/61
3,866,687 A * 2/1975 Banner ..... 169/61
3,949,812 A * 4/1976 Hay ..... 169/61
4,082,148 A * 4/1978 Willms ..... 169/61
4,256,181 A * 3/1981 Searcy ..... 169/65
4,305,469 A * 12/1981 Morrisette ..... 169/61
4,313,501 A 2/1982 Eckert
4,356,870 A * 11/1982 Gaylord et al. ..... 169/65
4,524,835 A 6/1985 Mingrone
4,580,638 A * 4/1986 Jones et al. ..... 169/49
4,675,541 A 6/1987 Paters
4,773,485 A * 9/1988 Silverman ..... 169/65
4,813,487 A * 3/1989 Mikulec et al. ..... 169/65
4,830,116 A * 5/1989 Walden et al. ..... 169/65
4,830,119 A 5/1989 Walden
4,834,188 A * 5/1989 Silverman ..... 169/65
4,887,674 A 12/1989 Galosky
4,979,572 A * 12/1990 Mikulec ..... 169/65
4,984,637 A 1/1991 Finnigan
5,048,791 A 9/1991 Ellison
5,127,479 A * 7/1992 Stehling et al. ..... 169/65
5,186,260 A 2/1993 Scofield
5,297,636 A * 3/1994 North ..... 169/65
5,351,760 A * 10/1994 Tabor, Jr. ..... 169/65
5,660,236 A * 8/1997 Sears et al. ..... 169/72
5,697,450 A * 12/1997 Stehling et al. ..... 169/65
5,871,057 A * 2/1999 Stehling et al. ..... 169/65
6,029,751 A 2/2000 Ford
6,044,913 A 4/2000 Stehling
6,170,480 B1 * 1/2001 Melink et al. ..... 126/299 R
6,186,241 B1 2/2001 Murr
6,354,256 B1 * 3/2002 Ohanian et al. ..... 123/179.21
6,871,802 B2 * 3/2005 Stilwell et al. ..... 239/583
2002/0184786 A1 * 12/2002 Miller, II ..... 34/132
2004/0145466 A1 * 7/2004 Anthony et al. ..... 340/522
2004/0194977 A1 * 10/2004 Stilwell et al. ..... 169/49

* cited by examiner

*Primary Examiner* — Len Tran
*Assistant Examiner* — Trevor E McGraw

(57) ABSTRACT

An improved fire protection system that is of fail safe design for kitchen stoves with or without a range hood and other applications utilizing electrical power for generating heat and in which a fire condition such as a skillet of grease becomes ignited. Said system is activated thermally to release a quantity of fire suppressant material while simultaneously cutting off the electrical power. The system utilizes a reservoir containing the fire suppressant under pressure with a hose or pipe connected to one or a plurality of thermally activated nozzles. A second hose or pipe is connected to a pneumatically operated electrical interruption device.

3 Claims, 7 Drawing Sheets

COOKSTOVE FIRE EXTINGUISHING SYSTEM

BACKGROUND OF THE INVENTION

Prior Art

The use of automatically activated fire extinguishing devices for cooking stoves is known. Such devices provide a source of fire extinguishing compound to be released on to a stove surface in the event of a fire which occurs during use of the appliance. Virtually all prior art devices are designed and made only for installation within a range hood though preference today often calls for a microwave oven mounted over the cooking stove or such device without a traditional range hood, thereby eliminating the mounting space for the prior art devices.

Even the smallest prior art device installed in a range hood leaves much to be desired in appearance due to the wires, pipes extinguishing nozzles and tanks that can be easily seen by persons near the stove and over time collect unsightly grease and dirt and are difficult to clean.

Prior art automatic fire extinguishing installations sometimes include an automatic shutoff arrangement for shutting off the electricity to the stove, upon detection of a fire. Known shutoff arrangements are generally complex, expensive, and present added components subject to faults and errors in installation and operation. Such devices quite often require professional services such as electricians for their installation, thus this also contributes to onsite installation time and expense.

There is thus a need in the art for a fire extinguishing device which is unobtrusive in appearance, is fail safe, and lends itself to quick and easy installation without the need for professional services.

The following discussed patents are a good representative sample of all prior art patents found.

Prior inventors such as U.S. Pat. No. 4,313,501 to Eckert (1982) have relied on taught wires with fusible disks for their operation under a range hood while the fuel flow to the fire is shut off by a cable arrangement operating through a torturous path to a valve handle. Very little information is provided as to how this is to be done.

Another invention, U.S. Pat. No. 4,979,572 to Mikulec, (1990) again requires a range hood for its operating space and electrical power to the stove is cut off by an arrangement to pull the electrical feed plug from the wall and is activated by a cable means similar to the previously mentioned patent by Eckert. This method was later seen as impractical and was later dropped in a succeeding patent, Mikulec U.S. Pat. No. 5,899,927 (1999), for a much more complicated interruption method. A gas valve for shutting off the gas supply to a gas operated stove is also operated by pulling a cable and releasing a spring powered valve. An alternate method of interrupting the gas supply is offered by Mikulec in U.S. Pat. No. 5,899,927 with an acoustically operated electronic system which introduces more complication and possibility of error unless the owner is well versed in testing and maintenance of the system. Both means of operation require considerable on site labor for both installation, adjustment, and some components could fail during an emergency.

U.S. Pat. No. 4,984,637 by Finnigan (1991) again requires a range hood to hide the mechanism and uses a thermocouple and accompanying electronics to give a temperature display and sound an alarm. A brief mention is made that relays and valves can be used to cut off the stove heating energy. The main emphasis of this patent is that the system will turn off water or other suppressants when the temperature drops. This does not really solve the problem of a grease fire for water is the wrong material to use in such an instance and further the system is intended for a large liquid reservoir system to utilize the cycling on and off.

U.S. Pat. No. 5,127,479 by Sthling et al. (1992) is strictly a range hood system much like the previously mentioned patents by Mikulec which utilizes cables and chain with heat melting links. A 12 volt battery back up system is referred to for powering an undefined valve or relay to cut off gas or electricity to the stove. If the home owner does not check the battery system regularly the system could easily fail to shut off the stove energy source in a fire emergency.

U.S. Pat. No. 5,207,276 by Scofield (1993) operates only with a range hood and utilizes a twisted pair of wires in which the insulation melts to allow the two wires to short. The operation of the system depends on a battery backed up system. Energy cut off to the stove, though critical, is not mentioned.

U.S. Pat. No. 5,868,205 by Cunningham et al. (1999) is designed to be used only with a range hood and has no means to cut off energy to the stove.

U.S. Pat. No. 5,697,450 by Stehling, et al. (1999) is a fully electronic system for a range hood with acoustic triggered cut off of gas or electric energy to the stove. This system is totally dependent on electrical power and is subject to many faults and consequently is not fail safe. Blocking any of the acoustical properties by accumulation of dirt behind the stove by the system could prevent the shut off of energy to the stove.

U.S. Pat. No. 5,899,278 by Mikulec (1999) is a self contained unit for range hood mounting and has no provision for energy shut off to the stove.

U.S. Pat. No. 6,044,913 by Stehling et al. (2000) is an electrical system for a range hood fully dependent on battery power and acoustically linked to the energy shut off. This system therefore has the same limitation as U.S. Pat. No. 5,697,450 by Stehling (1999) listed above.

U.S. Pat. No. 6,276,461 by Stager (2001) is a mechanically operated system for a range hood and has no provision for disrupting energy to the stove which could make the system ineffective.

U.S. Pat. No. 3,866,687 Banner 02-1975 Makes reference to operation with or without a range hood. the Banner system applied to a range hood utilizes a pressurized tank with piping to an electrically operated valve with nozzles within the range hood and beneath the burners. The pressurized tank is equipped with a pressure operated meter which is a requirement of approving authority when using unsealed pressurized fire extinguishing tanks. In applying the system to either a range hood or beneath the burner Banner uses electrically operated valves for discharge of the fire suppressant beneath the burners, which might prove less than effective.

U.S. Pat. No. 4,356,870 Gaylord et al. Nov. 2, 1982 System is for hoods only and utilizes an electrically operated solenoid valve for cut off of the gas and presumably uses an electrically energized relay to cut off the electrical power, which usually requires wiring and electricians. The system utilizes a spray nozzle which is connected to the building water supply and is usually considered to be the wrong material to fight a grease fire.

U.S. Pat. No. 4,830,116 Walden et al. May 16, 1989 System is for range hoods and utilizes electrical equipment to disconnect the power source.

U.S. Pat. No. 5,351,760 Tabor Jr. Oct. 4, 1994 System is for range hoods. Tabor claims the system is pressurized but it is actually pressurized only to an electrically operated release valve adjoining the retardant tank. The spray nozzle of this system is a passive device and is not thermally actuated. Further the spray nozzle has to spray material of a viscosity of one, which is probably water and the nozzle is a cooling spray nozzle of limited capacity usually associated with cooling back porches.

These prior art devices have the disadvantage of being designed only for under or within a range hood even though today thousands of kitchens are designed with a microwave oven in place of the range hood. Some require taught wires that require some experience to install and are in a position under a range hood to collect grease and dirt and with such pipes, wires, and other paraphernalia will be difficult to clean. Others rely on electronics for acoustically operating the disruption in electricity or gas and are inherently less reliable than a fail safe system. It must be kept in mind that the average home owner will seldom think of maintenance for such a system and therefore systems of such design can fail long before they are needed in an emergency.

BACKGROUND OF INVENTION

Objects and Advantages

There is a need in the art for a fire extinguishing system which will satisfy the needs of those kitchen type stoves that do not have range hoods and to provide a system that will be of low cost to install, have high reliability, and not require professional services in its installation. Accordingly, several objects and advantages of the present invention are:

(a) to provide a fire extinguishing system for a cooking type stove that is fail safe;

(b) to provide a fire extinguishing system that can be installed without the need for professional services;

(c) to provide a fire extinguishing system that will be versatile and allow installation of components in other than a single type of application;

(d) to provide a fire extinguishing system that can interface with a number of different extinguisher nozzles to meet differing requirements;

(e) to provide a fire extinguishing system in which its electrical power interruption requires only minimal plug in type installation;

Still further objects and advantages will become apparent from a consideration of the ensuing description and drawings.

SUMMARY

In accordance with the present invention a fire extinguishing system of fail safe design for kitchen type stoves utilize electric power for cooking energy that not only provides fire sensing and extinguishing but also provides effective disconnection of the energy source for heating and does not require professional services in its installation.

BRIEF DESCRIPTION OF THE DRAWINGS

For a full understanding of the invention the following detailed description should be read in conjunction with the drawings, wherein.

DETAILED DESCRIPTION OF THE PREFERRED EMBODIMENTS

Figure 1:
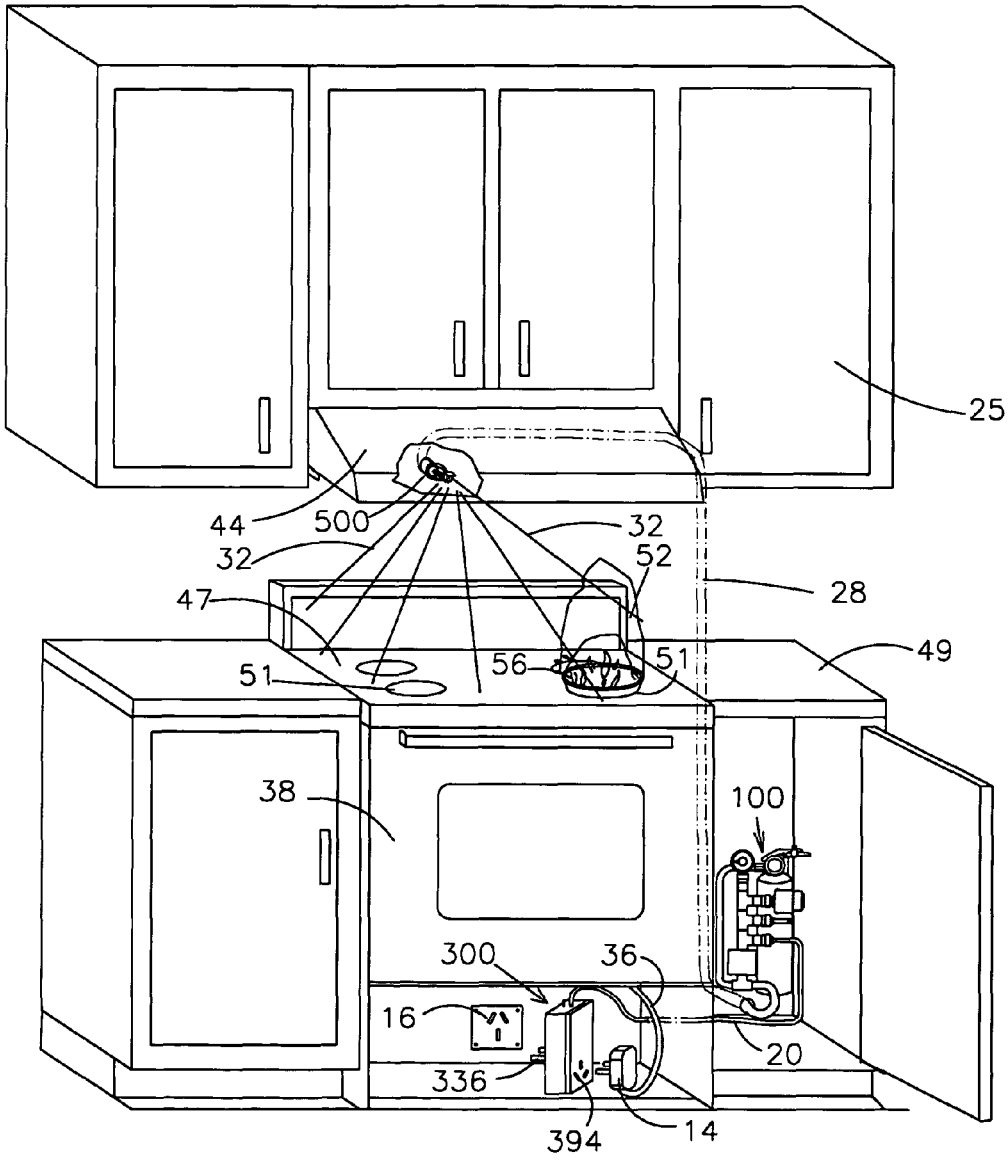
FIG. 1 is a perspective view of the fire extinguishing apparatus of the present invention applied in this instance to an electric stove with a range hood.

The preferred exemplary embodiments of the invention are illustrated in FIG. 1 through FIG. 4E wherein like numerals represent like parts. In the drawings, closely related figures have the same number but different alphabetic suffixes. Each segment of the system is discussed in detail individually.

FIG. 1 illustrates an application to an electric stove 38 of the preferred embodiment with a range hood 44 and with the control unit 100 located in a cabinet 49 and connected by high pressure hose or piping 20 to a pressure operated electrical interruption device 300 which is plugged by male connector prongs 336 into an electrical wall outlet 16 and the said electrical interruption device then provides internal female receptors for an outlet 394 for the stove electrical plug 14 to be plugged in to supply electrical current through cable 36 to the said electric stove heating elements 51.

Fire suppressant under pressure in the hoses and piping 28 FIG. 1 and originating in the said control unit supplies pressurized gas and extinguishment by hose or piping 28 to a thermally actuated spray head 500. The said control unit may be mounted in a cabinet over the said stove 25 or in a side cabinet 49 FIG. 1 as illustrated, or any near by space within an engineer approved distance. Said hoses or piping would be generally installed inside the wall space on both existing and new construction.

In the event of a skillet 56 FIG. 1 or other container being left on the said stove and becoming overheated a fire 52 FIG. 1 will soon result activating the said thermally activated spray head thereby releasing the pressurized extinguishing agent 32 within the said hoses or piping and vessel containing fire extinguishing material under pressure in the said control unit spraying the top 47 of said stove, thereby extinguishing said fire. The resulting loss of pressure within the system releases a latching device in said electrical interruption device cutting off the flow of electrical current to the said stove thereby removing the source of the heat to the said skillet. The loss of pressure also causes an alarm pressure operated switch 400 to activate switches to transmit an alarm to a remotely monitored location.

Figure 2:
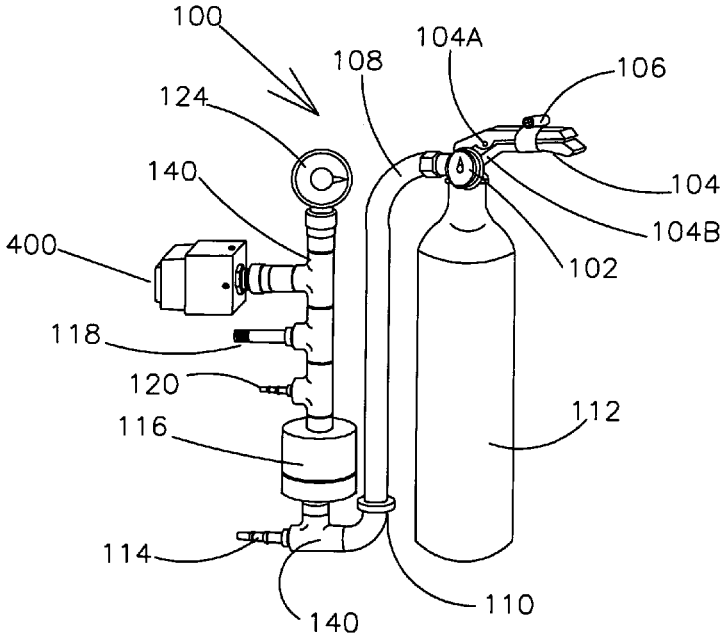
FIG. 2 is a perspective view of the control unit showing its associated parts.
Figure 3:
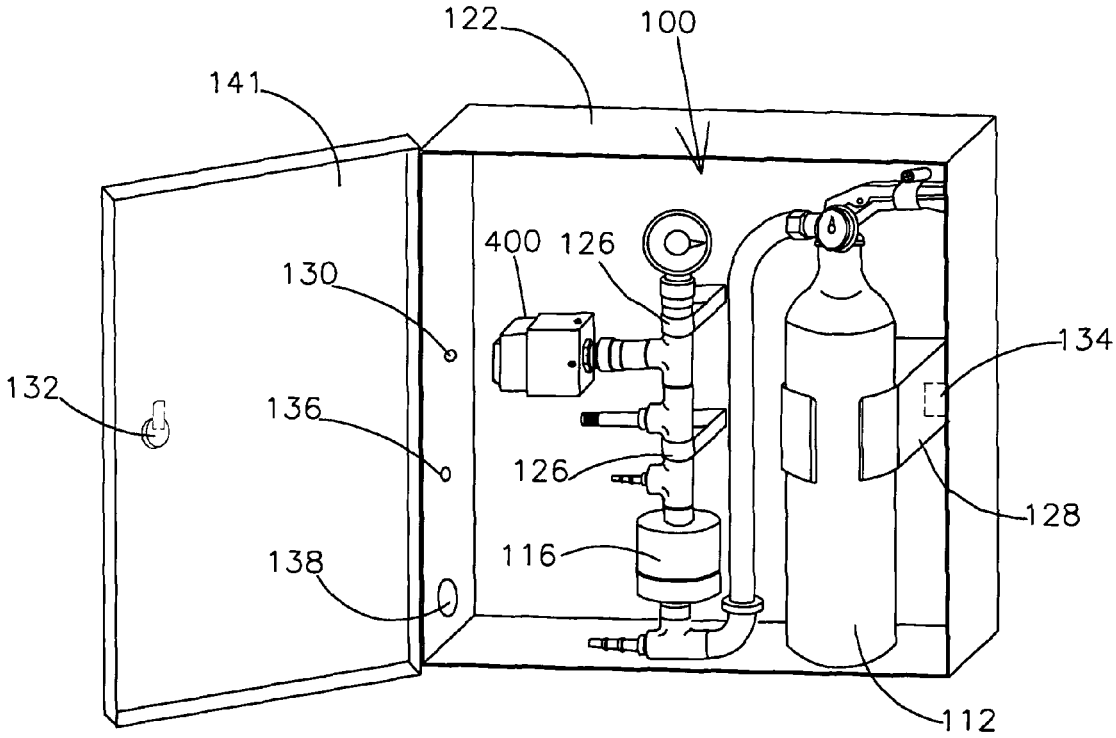
FIG. 3 is a perspective view of the control unit mounted typically in a cabinet.

FIG. 2 illustrates a control unit 100 while FIG. 3 illustrates a control unit as it would normally be housed in a cabinet 122. The said control unit includes a vessel 112 under pressure and containing fire suppressant.

The said vessel 112 is initially installed with full design pressure as indicated with pressure gauge 102. When placing the system in operation after installation and verifying its integrity, the fire suppressant release lever 104A is depressed against the fixed device 104 and permanently locking an internal valve in an open condition by applying a locking device 106 which will sufficiently hold the internal valve of the vessel 104B in a potentially dischargeable condition.

The said vessel is in communication with the said suppressant system by hose or pipe 108 through a connector 110 to piping connecting to a connection device for hose or piping 114 allowing passage of gas propellant from said vessel to the said thermally actuated device through said hose or piping. FIG. 1.

Pressure within the said vessel also feeds through connecting piping 140 through a conventional in line filter 116 to a hose barb or connector 120 to apply pressure to the pressure activated electrical interruption device 300 FIG. 1.

Said pressure also is applied through said connecting piping to the pressure operated alarm monitoring switch 400 and to a pressure gauge 124 whose purpose is for initial leak detection and setup operation with the initial gas for testing being induced through valve stem 118 prior to opening said valve 104B.

A cabinet 122 FIG. 3 constructed of material adequate for the purpose provides restraining strapping 128 for restricting movement of the said suppressant vessel. Additional restraining devices 126 hold the companion piping and devices in a restrained and vertical position to limit the effect of any powdery suppressant that may pass through the filter 116.

Said cabinet 122 FIG. 3 shall include a cover with a means of holding the cover in a closed position with the aid of latching device 132 engaging another cabinet mounted device 134 to hold said cover in a closed position when not being serviced. A penetration 138 is provided within the said cabinet for connection of the fire suppressant discharge hose or piping 28. FIG. 1 and another penetration 136 is provided for the pressure line 20. FIG. 1 An additional penetration 130 FIG. 3 is provided for installing an alarm monitoring cable for connection to the said alarm monitoring switch 400.

The said extinguishing unit can be placed in any other convenient space such as an adjoining room or even an attic space with reasonable access provided such location is within a predetermined maximum distance provided through engineering calculations that is adequate for transmission of the fire suppressant by means of the high pressure hose or piping 28. FIG. 1.

Figure 4B:
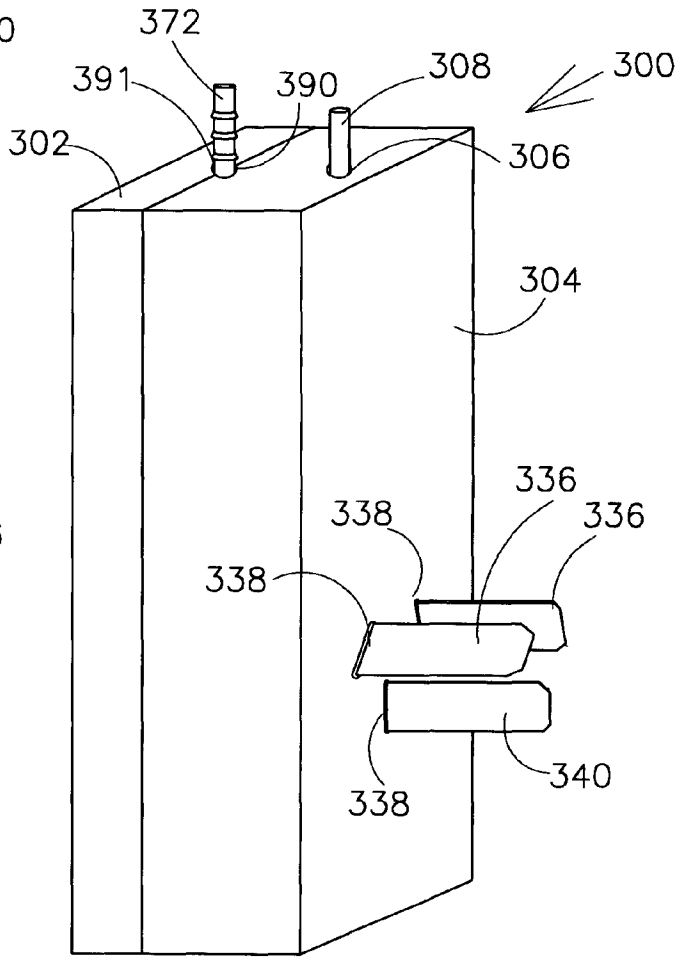
FIG. 4B perspective view of the electrical interruption device showing a back view.
Figure 4A:
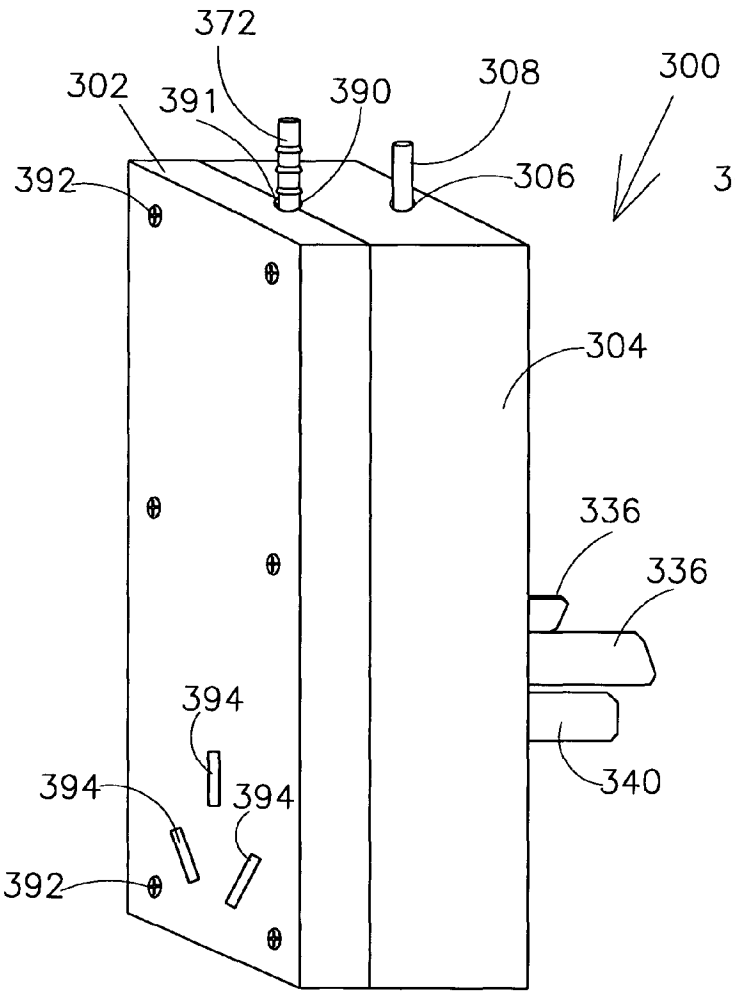
FIG. 4A perspective view of the electrical interruption device showing a front view.

Electrical interruption device identified as item 300 in FIG. 4A is housed in a case 302, 304 of which the front of case 302 is affixed to the case back 304 by screws 392 and provides openings 394 on the said front of case 394 for plugging in a three prong male electrical plug. Channels 391, 390 are made in the said case parts to allow a hose barb or other connector 372 to protrude for access to a pressure source such as the said pressurized vessel of the control unit. FIG. 2.

The upper most part of the said case back in FIG. 4A has an opening 306 for access to a reset device 308. The most outstanding uniqueness of the present device is shown by the protrusion from the rear by male connector prongs 336, 340 through ports 338 in the back side of the said case 304 for directly plugging into an electrical power outlet 16 FIG. 1 thereby causing the total electrical installation to consist of plugging said electrical interruption device into a wall socket and a male socket 14 into the front portion of the electrical interruption device 300 and into internal female receptors as in FIG. 1.

Figure 4C:
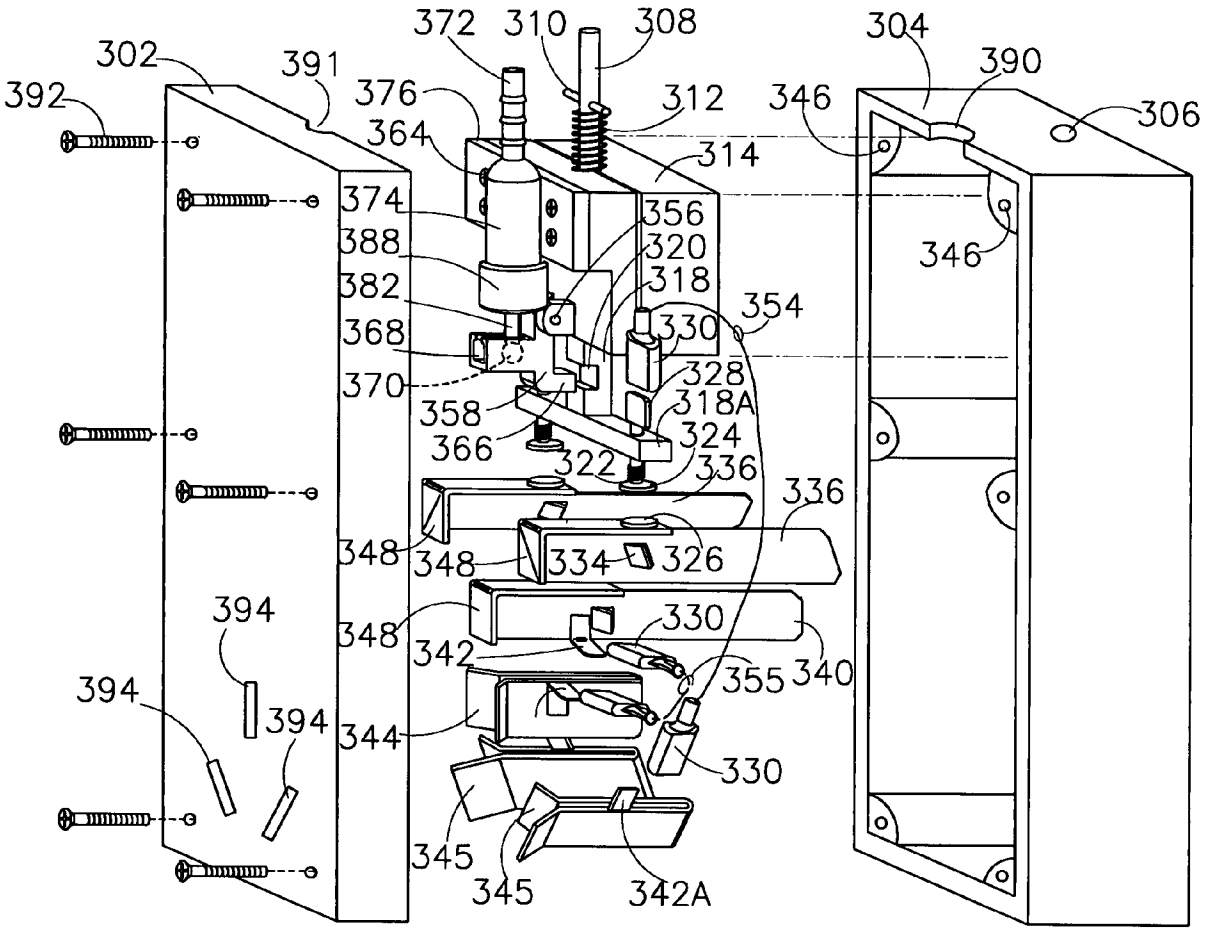
FIG. 4C exploded perspective view of the electrical interruption device in a partially assembled condition.
Figure 4D:
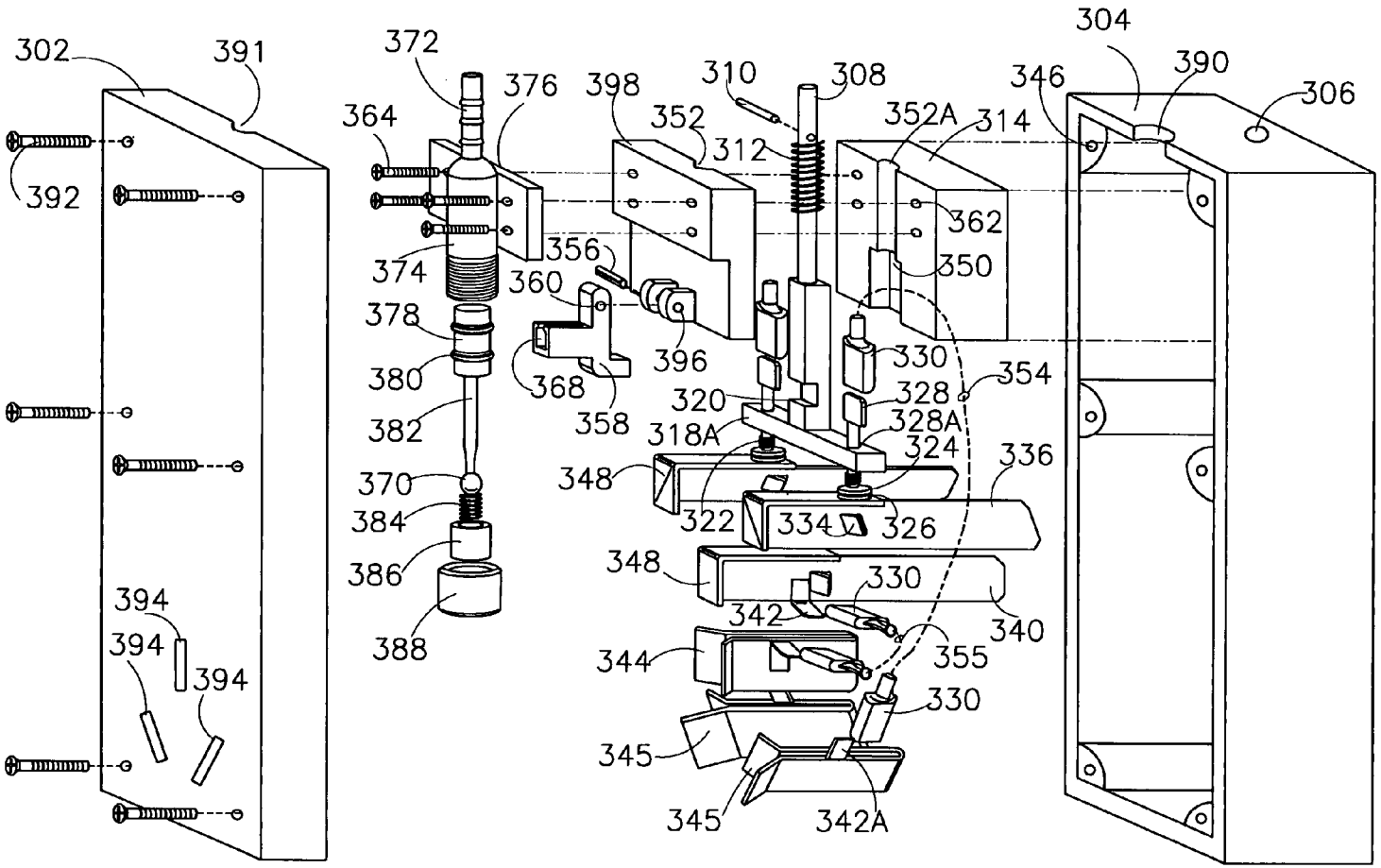
FIG. 4D exploded perspective view of the electrical interruption device.

FIG. 4D is an exploded view of all operating parts of said electrical interruption device. Gas pressure enters a hose barb or connector 372 and applies pressure within the cylinder 374 on piston 378 while o-rings 380 restrict leakage by sealing yet sliding against the walls of said cylinder. Said piston, with sufficient pressure applied, forces against a connecting rod 382 which controls the movement of a hold release lever 358 with force through a spherical shaped 370 slide in connector.

An opposing force supplied by spring 384 pressing against the interior of the end cap 388 and the base of said piston will return said piston to its uppermost position when gas pressure within the said cylinder is relaxed. The maximum travel of said piston is restricted by a limit washer 386 which limits said piston travel by the top surface of said limit washer pressing on the said piston bottom surface while the said limit washer bottom surface presses against inside bottom surface of the said end cap therefore limiting the maximum travel of the piston during periods of substantial gas pressure on the said piston.

Said cylinder is formed to a mounting plate 376 which is anchored by screws 364 to a front mounting block 398 which includes a hinge bracket 396. Attached to said hinge bracket by means of a hinge pin 356 is the said hold release lever 358. Said spherical shaped connector engages the said hold release lever by sliding the said spherical shaped connector into and being held within a catchment 368 and thereby controlling the movement of said hold release lever. A latch protrusion 366 engages a notch 320 in a contact riser assembly 318 and when so engaged locks said contact riser assembly firmly in a downward position.

The said contact riser assembly, FIG. 4D, is sandwiched between the said front mounting block and rear mounting block 314 in a groove 352 and 352A. Said contact riser assembly is pressed upward by stored kinetic energy in spring 312 resting one end on the top of said front mounting block and top of said rear mounting block. The top portion of the contact riser assembly 308 serves the purpose as a push to reset device and holds a locking pin 310 which restrains the top portion of said spring by pressing on the interior of said rear portion of case 304.

The said front mounting block and said rear mounting block along with the said mounting bracket for cylinder 374 are secured together by screws 364 which engage screw threads in holes 362 in said rear mounting block which is actually molded as an integral part of the case back 304.

When pressure decreases sufficiently on said cylinder, the said piston rises due to the urging of said spring 384 FIG. 4D which thereby causes the said hold release lever 358 FIG. 4C to rotate around said hinge pin and disengage from notch 320 thereby allowing the contact riser assembly 318 to quickly move upward propelled by compression spring 312. The contact riser assembly continues its upward travel until the flat surface area 316 strikes the limit surface 350, as seen in FIG. 4D.

The said contact riser assembly includes two electrical contacts 324 mounted to contact connector lugs 328 that mount through holes 328A FIG. 4D in the extension arms 318A of the said contact riser assembly. Said lugs can move freely within the said holes of the said extension arms. When the said contact riser assembly is in the locked down position the said moveable contact 324 becomes mated to a fixed contact 326 with proper contact pressure being supplied by coil springs 322 pressing on the said extension arms and the moveable contacts 324.

Figure 4E:
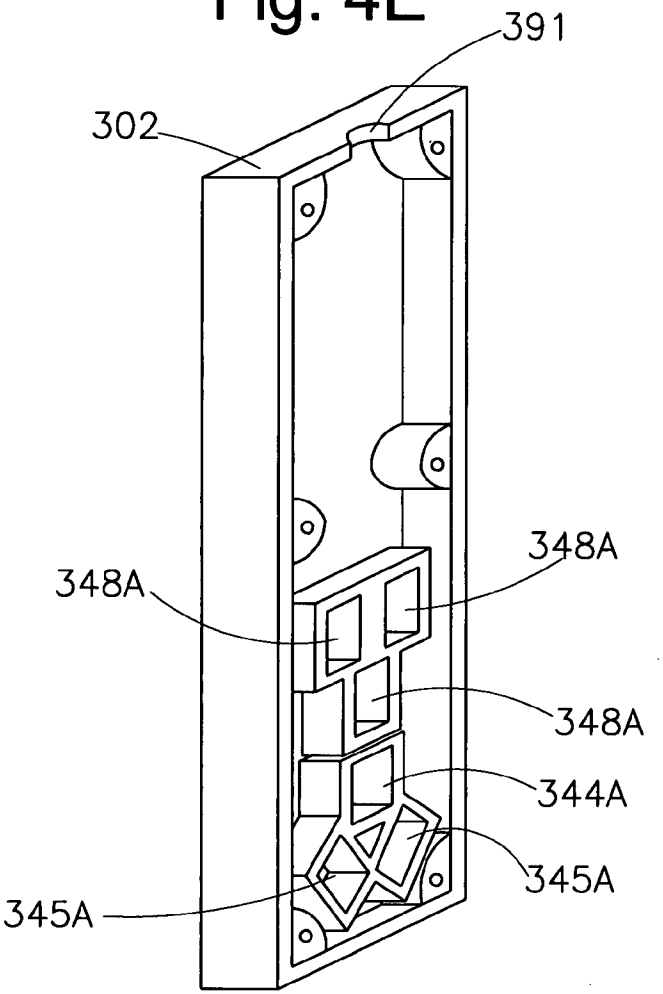
FIG. 4E perspective view of the electrical interruption device.

The fixed mating contact 326 is part of a prong mounting bracket 348 which serves to provide electrical conduction to male contact prong 336 and also serves as a mounting means for the said prong in the front of case 302 in openings 348A FIG. 4E.

Male contact prong 340 FIG. 4C is for ground or neutral conduction and is electrically connected to one internal female receptor ground or neutral connector 344 through tabs 342 with push on connectors 330 with wire conductor 355. Two additional internal female receptors 345 for connection by means of tabs 342A utilize two additional push on connectors 330 with wires 354 to connect to the said electrical moveable contacts 324 through the contact connector lugs 328.

All above operating parts are mounted within the case back 304 with the reset lever 308 protruding through the hole for reset 306 and the male prongs 336 and 340 protrude through apertures 338 FIG. 4B in the said case back with the movement of said male prongs limited by the insertion limit tabs 334 that limit the rearward movement of said prongs by pressing on the case back. The opposite end of the male connector prongs 336 and 340 with their respective prong mounting brackets 348 are restrained by pockets molded in the front case 302 FIG. 4E and snugly fitting in the restraining space 348A.

The receiving end of the female receptors 344, 345 are in line with openings 394 FIG. 4C and fitting into their respective restraining pockets 344A and 345A FIG. 4E molded in the front case 302 FIG. 4E.

FIG. 4C is a partially exploded perspective of the operating units of the said electrical interruption device. The electric plug 14 FIG. 1 plugs into the female receptor 394. FIG. 1 and FIG. 4C. The male connector prongs 340, 336 FIG. 4B are plugged into the wall mounted electrical outlet 16 FIG. 1. With sufficient gas pressure applied to the hose barb or connector 372 the reset 308 FIG. 4C can be manually pushed sufficiently which will cause the contacts 324 to engage the fixed contacts 326 while the gas pressure on the piston 378 will cause it's catchment 368 to move in the opposite direction causing the said catch 366 to engage the notch 320 thereby locking the said contact riser assembly 318 in a condition where with spring force from the contact pressure springs 322 will cause proper pressure to be applied to the contacts 324 making firm contact with the fixed contacts 326. Electrical conduction is then complete from the male connector prongs 336 through the prong mounting brackets 348 to the fixed contacts 326, through the moveable contacts 324 to the connector lugs 328. Electrical conduction is then through the connectors 330 and wires 354 to connectors 330 pushed onto tabs 342A of the internal female receptors thereby completing the electrical circuit through the electrical interruption device 300 and connecting to an external electrical plug 14 and cord 36. FIG. 1.

Upon the loss of pressure on the said cylinder 374 FIG. 4C the said connector rod 382 will rise causing the piston connector sphere 370 to lift and thereby rotate the hold release lever catchment 368 freeing the catch 366 from the notch 320 of the connector riser assembly 318. The said connector riser assembly quickly rises urged by the spring 312 and thereby removing pressure on the said contacts 324 causing them to separate a sufficient distance to break the electrical conduction between said contacts 324 and 326 and any carryover arching.

This totally pressurized fire protection system is provided with a pressure operated alarm switch 400 FIG. 3 that can be used for remote alarm monitoring.

The fire protection system of this invention can utilize a multitude of conventional thermally actuated spray nozzles of several vendors to be selected according to the space to be covered with the fire suppressant.

ADVANTAGES

From the description above, a number of advantages of my kitchen type fire protection system become evident:

(a) The control unit cabinet that houses the suppressant vessel and provides the pressurized fire suppressant does not require extensive installation and can be placed in any number of locations in the near vicinity of the protected area. This unit provides a pressure gauge for checking the pressure integrity of the system prior to placing the system in service.

(b) The system can be installed in instances either with or without a range hood.

(c) All components will be out of the view of persons near the stove except for one or more small thermally actuated nozzles. Collection of grease and dust on the operating components is severely minimized in comparison with others. Systems as described earlier have much of their equipment easily seen which detracts from the appearance of the kitchen and the pipes and wires are exposed for the collection of grease and dirt.

(d) Installation of the electrical interruption device to remove the source of the heat to the stove is by simple plug in means. Installation of tubing or piping to this device for operation of the interruption device utilizes only a small tube easily installed even to pulling the said tubing or piping inside a wall.

(e) Connection of the thermally activated spray nozzle to the control unit is by means of flexible hose or by piping.

(f) A very important feature of this invention is that it is continually pressurized and failure of the system such as a leak in the two hoses or piping will cause interruption of the electrical power to the stove therefore making it fail safe.

(g) Due to the simplicity of the installation the cost of this system for electric stoves should be well within the average home owners' affordability.

CONCLUSIONS, RAMIFICATIONS, AND SCOPE

Thus the reader will see that the fire extinguishing system presented here provides a highly reliable, easily installed system that can save property and lives.

While the above description contains much specificity, these should not be construed as limitations on the scope of the invention, but rather as an exemplification of the preferred embodiment thereof. Many other variations are possible. For example, the system can be installed as a protective system in confined instrument cabinets or in many other such applications where the fire extinguishment and the cut off of electricity is imperative.

The operational design of the equipment as presented herein is the presently preferred embodiments and variations of the basic designs might well result in future cost savings. The electrical interruption device could be made smaller and with a variation of the presently designed cocking mechanism could result in other savings in both space and cost. However, the simplicity of installation of the electrical power interruption is the systems main attributes.

Accordingly, the scope of the invention should be determined not by the embodiments illustrated, but by the appended claims and their legal equivalents.

The invention claimed is:

1. A system for extinguishing cooking stove fires, comprising:

a residential cooking stove having an electrical input for connection to an electrical power supply, wherein said cooking stove includes electrically energized heating elements which are energized by said electrical power supply;

a pneumatically operated electrical disconnect device having normally closed electrical contacts therein, wherein said pneumatically operated electrical disconnect device is interfaced electrically between said electrical power supply and said electrical input;

a fire extinguishing system comprising:

one or more pressurized vessels containing a fire extinguishing material which is pressurized by a propellant gas, wherein said pneumatically operated electrical disconnect device is in fluid communication with said one or more vessels; and one or more thermally actuated spray heads in fluid communication with said one or more vessels, wherein said one or more spray heads are located over said cooking stove;

wherein, in the event of a fire on said cooking stove, fire extinguishing material is released from said one or more vessels and communicated to said one or more spray heads to extinguish the fire, and simultaneously, gas pressure of said propellant gas is released from said one or more vessels and communicated to said pneumatically operated electrical disconnect device such that said gas pressure will cause opening of said normally closed electrical contacts thereby disconnecting said electrical power supply from said cooking stove and its heating elements.

2. The system for extinguishing cooking stove fires according to claim 1, wherein said pneumatically operated electrical disconnect device further includes a cylinder and a piston located therein, wherein when said gas pressure is present in said pneumatically operated electrical disconnect device, said gas pressure urges said piston against a spring loaded latching device to move said piston relative to said cylinder from a first position to a second position, and wherein when said gas pressure is decreased from said pneumatically operated electrical disconnect device, said piston is biased to move back to said first position by urging of a spring element of said spring loaded latching device.

3. The system for extinguishing cooking stove fires according to claim 2, wherein said spring loaded latching device includes a manual reset, such that when said gas pressure is present within said cylinder thus moving said cylinder towards said second position, said manual reset may be locked by a user into an unmovable condition whereby said electrical contacts are returned to a closed and electrically conducting position, and such that when said gas pressure is decreased from said pneumatically operated electrical disconnect device, said piston is rapidly returned to said first position by urging of said spring element.

* * * * *